US006679714B2

(12) United States Patent
Kimura

(10) Patent No.: US 6,679,714 B2
(45) Date of Patent: Jan. 20, 2004

(54) LOW INSERTION FORCE TYPE CONNECTOR

(75) Inventor: Makiya Kimura, Saitama (JP)

(73) Assignee: Tyco Electronics, AMP, K.K., Kanagawa (JP)

( * ) Notice: Subject to any disclaimer, the term of this patent is extended or adjusted under 35 U.S.C. 154(b) by 0 days.

(21) Appl. No.: 09/998,998

(22) Filed: Nov. 30, 2001

(65) Prior Publication Data

US 2002/0064987 A1 May 30, 2002

(30) Foreign Application Priority Data

Nov. 30, 2000 (JP) ..... 2000-364517

(51) Int. Cl.[7] ..... H01R 13/629
(52) U.S. Cl. ..... 439/261; 439/265; 439/372
(58) Field of Search ..... 439/259–270, 439/372

(56) References Cited

U.S. PATENT DOCUMENTS 2,654,872 A * 10/1953 Saul et al. ..... 439/261
4,407,555 A * 10/1983 Lockard ..... 439/259
4,512,621 A * 4/1985 Bethurum ..... 439/259
4,744,768 A * 5/1988 Rios ..... 439/262
4,969,831 A * 11/1990 Kuzuno et al. ..... 439/259

FOREIGN PATENT DOCUMENTS

JP 59-139583 8/1984 ..... 23/70
JP 4-342974 11/1992

* cited by examiner

*Primary Examiner*—Hien Vu

(57) ABSTRACT

The low insertion force type connector has a housing, contacts, shafts, main bodies of the shafts that urge the contacts, cams which maintain the mating connector at a depth that immediately precedes complete engagement, hook-shaped members which perform a gradually increasing locking operation with the mating connector, a lever, and a cover member. After the connectors have been engaged with each other to a depth that immediately precedes complete engagement, the lever is operated so that the cams are released. As a result, an electrical connection between the connectors is established by the main bodies; furthermore, the connectors are caused to approach each other even more closely by the hook-shaped members, so that wiping is performed, and so that the connectors are locked to each other.

5 Claims, 12 Drawing Sheets

LOW INSERTION FORCE TYPE CONNECTOR

FIELD OF THE INVENTION

The present invention relates to a low insertion force type connector, and more specifically relates to a low insertion force type connector that has a locking mechanism that locks in a state of complete engagement with a mating connector.

DESCRIPTION OF THE RELATED ART

As the number of contacts in a connector increases, and as connectors become so-called multi-pole connectors, the insertion force required for the mating of such connectors increases, so that the mating operation becomes difficult or impossible. Accordingly, low insertion force type electrical connectors known as LIF (low insertion force) connectors or ZIF (zero insertion force) connectors have been developed.

The electrical connectors disclosed in Japanese Unexamined Patent Publication No. 59(1984)-139583 and Japanese Unexamined Patent Publication No. 4(1992)-342974 are known as low insertion force type connectors of this type. The former disclosure relates to a zero insertion force type connector; in which fixed connecting terminals and plug terminals are electrically connected via contact parts fastened to a rotating shaft. In the operation of this connector, the plug terminals are first inserted in a state in which the plug terminals are separated from the fixed connecting terminals; next, the contact parts fastened to the rotating shaft are rotated by rotating the rotating shaft, thus causing these contact parts to contact both the plug terminals and the fixed connecting terminals, so that electrical connections are made.

Furthermore, the low insertion force type connector of the latter disclosure has an opening means that opens contact parts that are ordinarily in a closed state. After the connector is engaged with the contact parts in an open state so that the contact parts of the other connector are received, the opening means is released so that the contact parts of the two connectors are caused to contact each other. In a state in which the contact parts of the engaged connectors are in contact with each other, the two connectors are slightly separated, and the contact parts are wiped. This wiping is accomplished by using a sliding means. The connector is constructed so that the opening means and sliding means are successively driven by a cam driving member that slides in a rectilinear manner.

In both examples of the prior art described above, the engaged state or mated condition of the connectors is maintained by the frictional engaging force of the contacts which are in contact with each other. Accordingly, there is a concern that external forces to which the connectors are subjected may result in faulty contact between the contacts, or in a release of the engaged state of the connectors. Furthermore, in the case of the latter prior art, since a gap is created between the engaging surfaces of the two connectors for the purpose of wiping, it is difficult to judge from the external appearance whether the connectors are properly mated or not.

Furthermore, in the former connector, contact parts are required in addition to the rotating shaft in order to obtain a low insertion force, while in the latter connector, respective pluralities of members are required as the opening means and sliding means.

SUMMARY OF THE INVENTION

One object of the present invention is to provide a low insertion force type connector that is capable of low insertion force engagement accompanied by forcible wiping, that makes it possible to lock the two connectors to each other so that the completely engaged or mated state of the connectors can be confirmed, and that can maintain this completely engaged state by this locking means.

Another object of the present invention is to provide a low insertion force type connector which has a reduced number of parts.

The low insertion force type connector of the present invention has a housing with a plurality of contacts that contact the terminals of a mating connector. The housing has a contact urging means that urges and deflects the contacts, a separating means that maintains the mating connector which is engaged with the housing at an engagement depth that immediately precedes complete engagement, a locking means that locks the mating connector in a gradually increasing manner, and a driving means that integrally drives the contact urging means, the separating means and the locking means. The driving means being driven at the time of engagement with the mating connector so that the contact urging means causes the contacts to connect with the terminals of the mating connector, the separating means releases the maintenance of the engagement depth that immediately precedes complete engagement, and the locking means locks with the mating connector so that the mating connector is pulled into a state of complete engagement from the engagement depth that immediately precedes complete engagement.

The term "low insertion force type connector" also includes ZIF (zero insertion force) type connectors.

The driving means may be constructed so that this driving means has a shaft which is rotatably supported on the housing, and an operating member which is connected to this shaft, and so that the contact urging means, separating means and locking means are integrally formed on this shaft.

The present invention may be constructed so that the contact driving means is a first cam member that drives the contacts so that these contacts contact the terminals. The separating means is a second cam member that can assume a contact position in which the second cam member contacts the engaging surface of the mating connector immediately prior to the complete engagement therebetween, and a non-contact position in which the second cam member does not contact the engaging surface. The locking means is a hook-shaped member which has an engaging cam surface that engages with a projection on the mating connector so that the connectors relatively approach each other as the shaft rotates.

In the low insertion force type connector of the present invention, the housing is equipped with a contact urging means that urges and deflects the contacts, a separating means that ordinarily maintains the mating connector which is engaged with the housing at an engagement depth that immediately precedes complete engagement, a locking means that locks the mating connector in a gradually increasing manner, and a driving means that integrally drives the contact urging means, the separating means and the locking means. Furthermore, at the time of engagement with the mating connector, the driving means is driven so that the contact urging means causes the contacts to connect with the terminals of the mating connector, the separating means releases the maintenance of the engagement depth that immediately precedes complete engagement, and the locking means locks with the mating connector so that the mating connector is pulled into a state of complete engagement from the engagement depth that immediately precedes complete engagement. Accordingly, the present invention has the following effects:

Specifically, low insertion force engagement accompanied by forcible wiping can be accomplished as a result of the locking means pulling the mating connector inward from an engagement depth that immediately precedes complete engagement. Furthermore, complete engagement can be confirmed by the locking of the connectors to each other, and the completely engaged state can be maintained by this locking. Moreover, since there is no gap between the engaged connectors, it can be visually confirmed from the outside that the connectors are completely engaged.

Furthermore, in a case where the driving means has a shaft which is supported on the housing so that this shaft is free to rotate, and an operating member which is connected to this shaft, and the contact urging means, separating means and locking means are integrally formed on this shaft, the structure is simple, and the number of parts required is reduced.

Furthermore, the number of parts required is similarly reduced in a case where the contact urging means is a first cam member which urges the contacts so that these contacts contact the terminals, the separating means is a second cam member which can assume a contact position in which this cam member contacts the engaging surface of the mating connector immediately prior to the complete engagement, and a non-contact position in which this cam member does not contact the engaging surface, and the locking means is a hook-shaped member which has an engaging cam surface that engages with a projection on the mating connector so that the connectors relatively approach each other as the shaft rotates.

DESCRIPTION OF THE PREFERRED EMBODIMENTS

Figure 1:
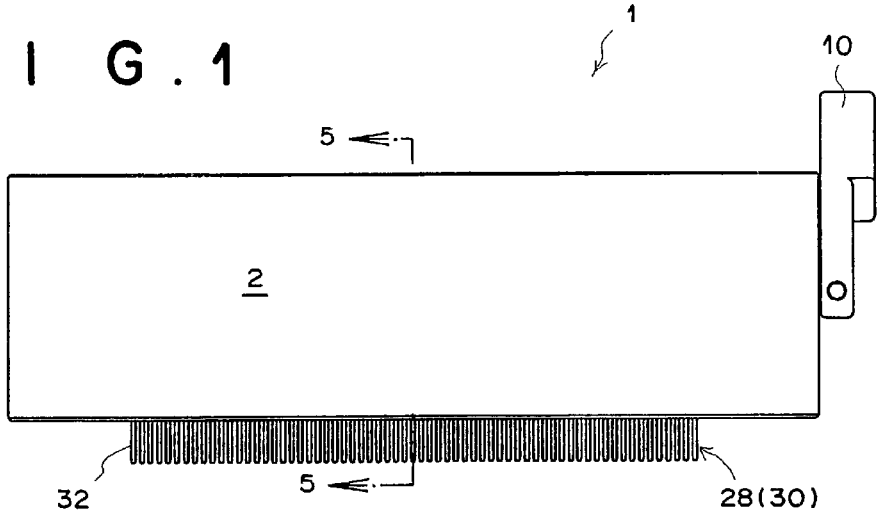
FIG. 1 is a front view of the low insertion force type connector of the present invention.
Figure 2:
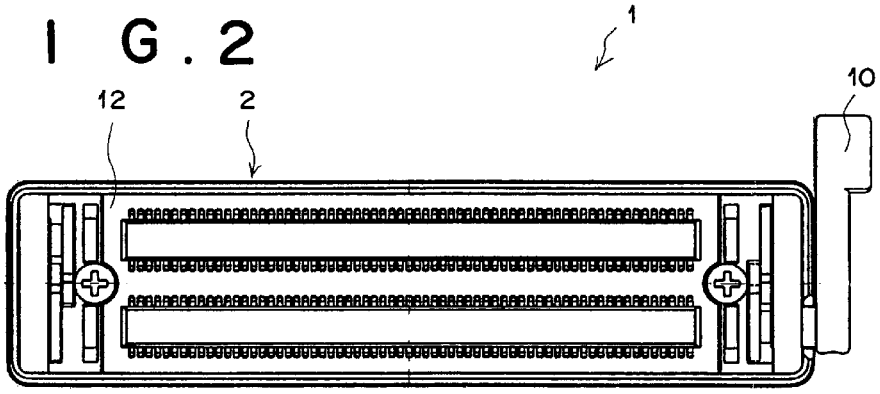
FIG. 2 is a plan view of the low insertion force type connector shown in FIG. 1.
Figure 3:
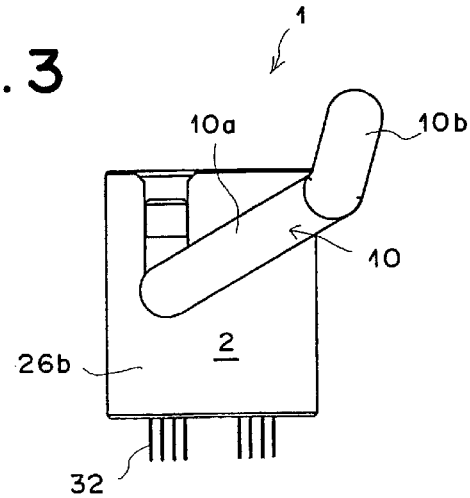
FIG. 3 is a side view of the low insertion force type connector shown in FIG. 1.
Figure 4:
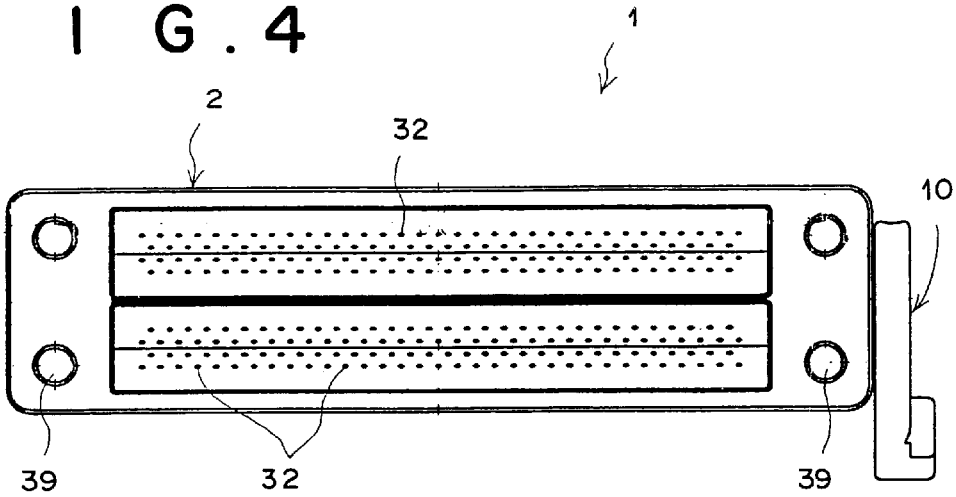
FIG. 4 is a bottom view of the low insertion force type connector shown in FIG. 1.
Figure 5:
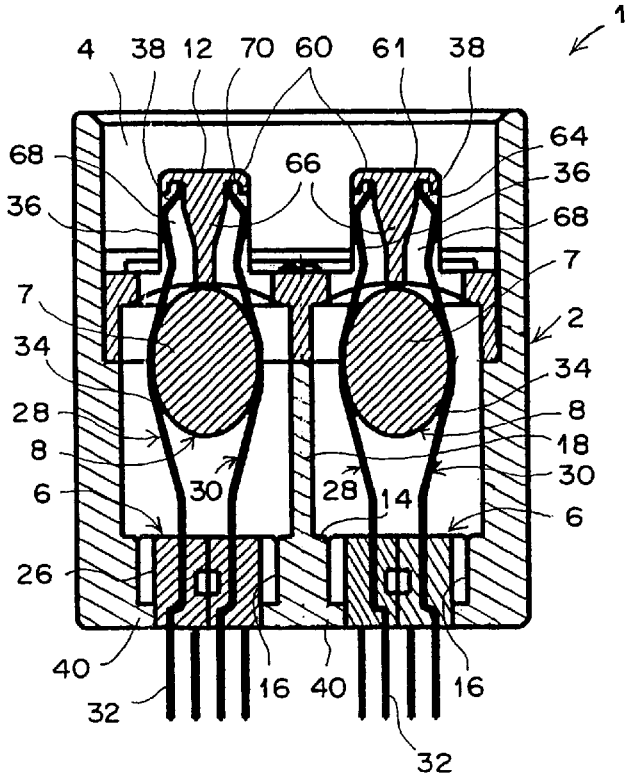
FIG. 5 is an enlarged sectional view of the low insertion force type connector along line 5—5 in FIG. 1.
Figure 6:
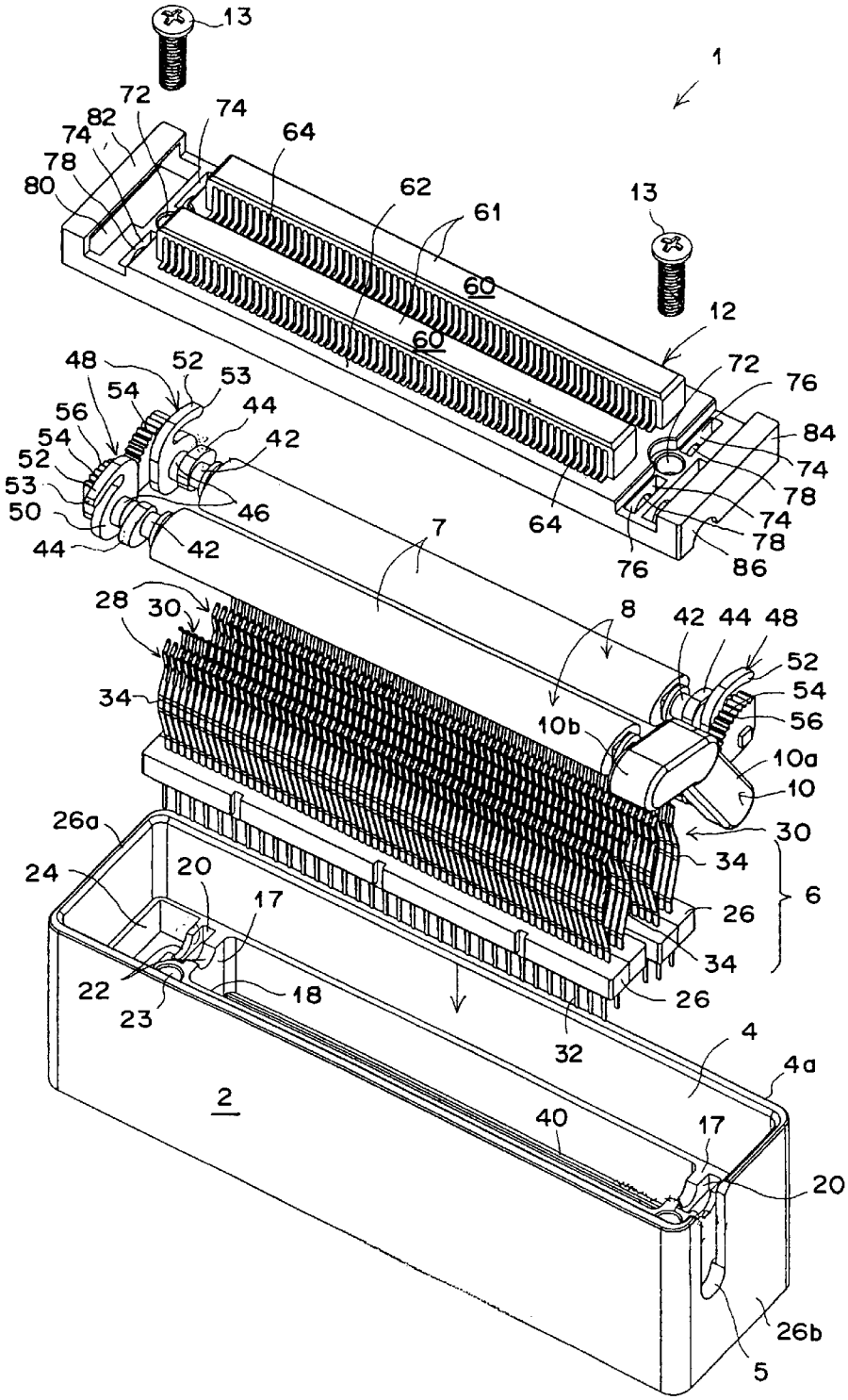
FIG. 6 is an enlarged exploded perspective view of the low insertion force type connector shown in FIG. 1.

The preferred embodiments of the low insertion force type connector (hereafter referred to simply as a "connector") of the present invention will be described in detail with reference to the attached figures. FIG. 1 is a front view of the connector of the present invention, FIG. 2 is a plan view of the connector shown in FIG. 1, FIG. 3 is a side view of the connector shown in FIG. 1, FIG. 4 is a bottom view of the connector shown in FIG. 1, FIG. 5 is an enlarged sectional view of the connector along line 5—5 in FIG. 1, and FIG. 6 is an enlarged exploded perspective view of the connector shown in FIG. 1. The following description will refer to FIGS. 1 through 6.

As is shown most clearly in FIGS. 5 and 6, the connector 1 has a rectangular parallelepiped housing 2 which has a recessed part 4, a contact assembly 6 which is disposed 15 inside the recessed part 4, shafts 8 which drive this contact assembly 6, a lever (operating member) 10 which is connected to these shafts 8, and a cover member 12 which holds these parts inside the recessed part 4. This housing 2 is formed from metal, e.g., die-cast zinc, etc., in order to provide electromagnetic shielding. Two rectangular openings 16 which extend in the lengthwise direction of the housing 2 are formed parallel to each other in a line in the bottom wall 14 (FIG. 5) of the housing 2. The inside edges of the respective openings 16 have flanges 40 (FIGS. 5 and 6) that protrude inward facing each other. Supporting walls 17 (FIG. 6) which have a height that is approximately one-half the height of the housing 2 are integrally formed on both end portions of these openings 16. A separating wall 18 which connects these two supporting walls 17 is integrally formed on the bottom wall 14 between the openings 16, 16.

As is shown in FIG. 6, in the upper surfaces of the supporting walls 17 on both end portions of the openings 16, relief grooves 20 are formed, and curved supporting grooves 22 are also formed adjacent to these relief grooves 20 on both sides of the relief grooves 20 so that these supporting grooves 22 pass through the relief grooves 20 in the elongate direction of the housing 2. Of the two pairs of supporting grooves 22, only the pair corresponding to the opening 16 on one side of the connector is shown in FIG. 6. A female threaded portion 23 is formed toward the bottom wall 14 between the two relief grooves 20 in the center of the upper surface of each supporting wall 17. Spaces 24 are formed on the outsides of the two supporting walls 17, i.e., on the insides of the end walls 26*a* and 26*b* of the housing 2. A cut-out 5 which extends downward from the upper edge 4*a* of the recessed part 4 is formed in the end wall 26*b*.

In the contact assembly 6, two types of contacts 28 and 30 with different shapes are respectively provided and held by insert molding in an insulating base member 26 which is molded from a synthetic resin. The base member 26 shown is one embodiment; other embodiments can be used without departing from the scope of the invention. The contacts 28 and 30 are formed by stamping and forming elastic copper alloy plates; each of these contacts has a main body 34, and a board engagement section 32 which extends downward from the main body 34 and is attached to a board (not shown in the figures). The main body 34 is formed so that it bows outward. In the present embodiment, the base member 26 is split into two members with rows of contacts 28 and 30 disposed on each of the two base members 26. The base members 26 are joined together and aligned by a dovetail engagement (not shown in the figures) at the joining surfaces of the two base members 26. As the base members 26 are press-fitted in the openings 16 of the housing 2, they are maintained in position relative to each other. In the alternative, the base member used may also be a single integral base member on which two rows of contacts are disposed. The attachment apertures 39 in the housing 2 shown in FIG. 4 are used to fasten the housing 2 to the board by means of bolts.

As shown in FIG. 5, the end portions of the bent main bodies 34 of the respective contacts 28 and 30 of the contact assembly 6 have contact parts 36 that converge inward and further extend rectilinearly. Anchoring end parts 38 of the contact parts 36 are bent further inward. The contact assembly 6 is attached to the housing 2 by mounting the base members 26 in the openings 16. Specifically, the base members 26 engage the flanges 40 that extend inward and which face each other inside the openings 16. In the embodiment shown, the board engagement sections 32 protrude downward from the bottom surfaces of the base members 26 as shown in FIGS. 1 and 3.

In the embodiment shown, the shafts 8 are formed from a metal material such as stainless steel; however, other materials having the appropriate strength characteristics can be used without departing from the scope of the invention. As shown most clearly in FIG. 6, there are two shafts corresponding to the two pairs of contact rows, with these shafts being respectively disposed between the rows of contacts 28 and 30. Furthermore, the shafts 8 are omitted from each of the sectional views shown in FIGS. 5, 14, 15, 17 and 18. The cross-sectional shapes of the main bodies or first cam members (contact urging means) 7, formed by insert molding on the respective shafts 8, form elliptical cams as shown in FIG. 5. Ordinarily, these main bodies are disposed in a state in which the long diameter of each elliptical cam is oriented in the vertical direction as shown in FIG. 5.

Second cam members (separating means) 44 are formed on both ends of each main body 7, with reduced-diameter parts 42 being interposed between the main body 7 and the second cam members 44. Furthermore, hook-shaped members (locking members) 48 are formed further to the outside with separate reduced-diameter parts 46 being interposed between the second cam members 44 and these hook-shaped members 48. As will be described later, the second cam members 44 have a roughly triangular shape with a rounded periphery. Ordinarily, the portion of each second cam member 44 that is furthest from the axial center, the stopping part 44*a* (FIG. 14), is disposed so that his portion faces upward, i.e., toward the mating connector. With the second cam member in this position, the main body 7 or first cam member of each shaft 8 is in the position shown in FIG. 5. The shafts 8 and the lever 10 attached to the shafts 8 are referred to as the driving mechanism. In the present embodiment, the second cam members 44 are formed as integral parts of the shafts 8; however, it would also be possible to use separate cams. Also in the embodiment shown, the hook-shaped members 48 are attached to the end portions of the shafts 8 as separate members.

Figure 10:
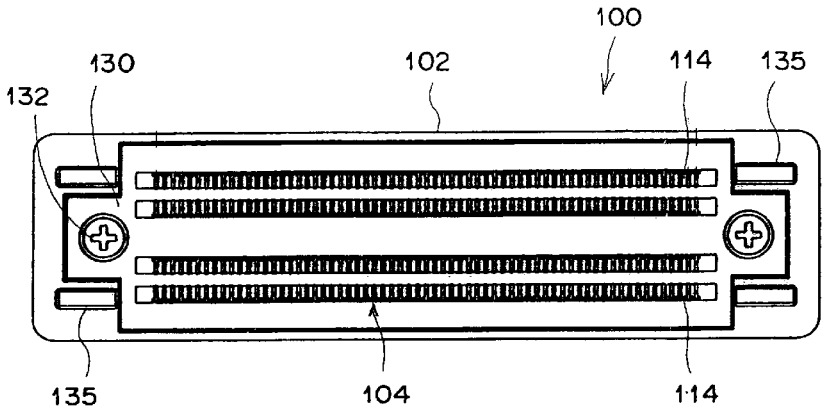
FIG. 10 is a bottom view of the connector shown in FIG. 7.
Figure 16:
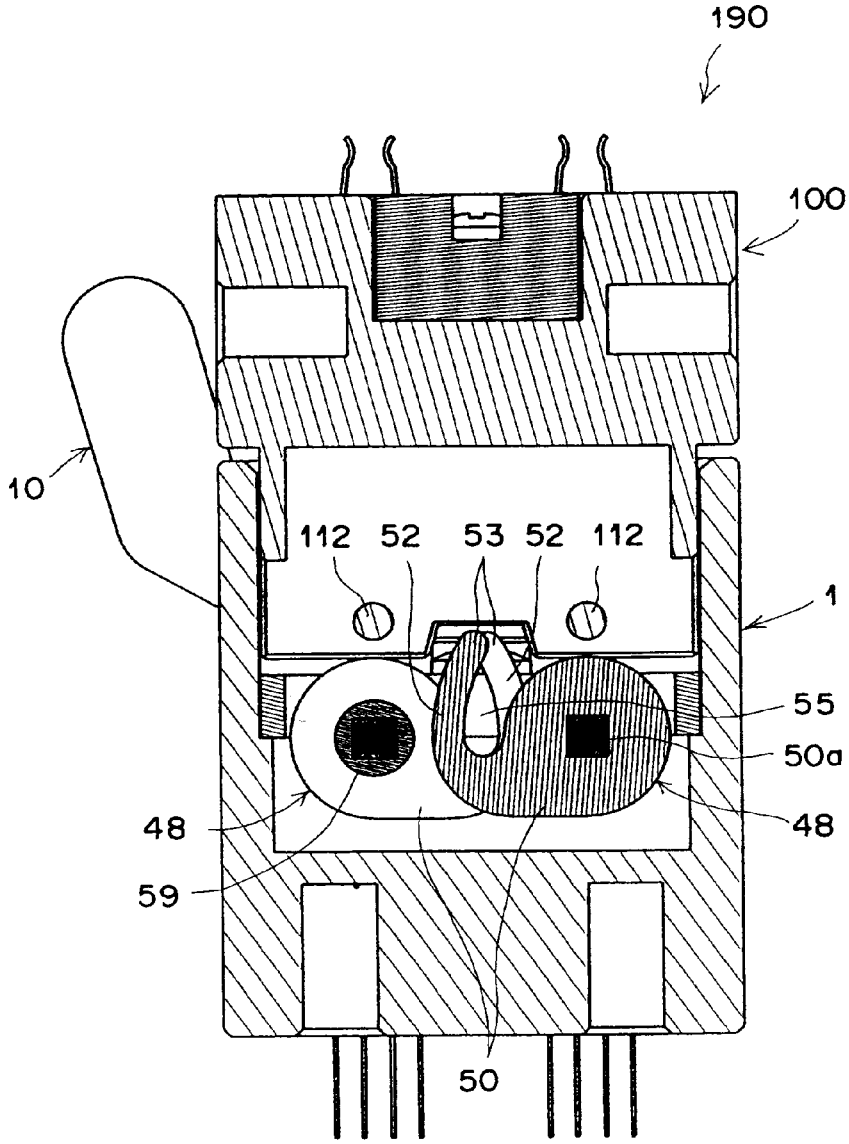
FIG. 16 is an enlarged sectional view of the connector assembly along line 16—16 in FIG. 11.

Referring to FIGS. 6 and 16, each of the hook-shaped members 48 has a flat-plate part 50 that pivots together with the corresponding main body 7, and a claw 52 that extends from this flat-plate part 50 and which has a shape that runs roughly along a circular arc of rotation about the corresponding shaft 8. The claws 52 are ordinarily in a state in which the tip ends 53 of the claws 52 face upward between the two shafts 8 (FIG. 10). Referring back to FIG. 6, gears 54 are formed adjacent to the hook-shaped members 48 on the outsides of the hook-shaped members 48. Specifically, these gears 54 are formed on both end portions of each shaft 8, and are formed with a fan shape so that the two shafts 8 engage with each other. The teeth 56 of the gears 54 are formed on the circular arc surface of the fan shape. The lever 10 is attached to the end portion of one of the two shafts 8, and consists of an arm 10*a* and an operating part 10*b*.

When the shafts 8 are disposed in specified positions, the reduced-diameter parts 42 and 46 of the respective shafts 8 are carried in the corresponding supporting grooves 22, and the second cam members 44 are accommodated inside the relief grooves 20. In this state, the teeth 56 of the gears 54 engage with each other, so that when the lever 10 is turned, the lever 10 moves in linkage with the connected shaft 8, and the other shaft 8 is also rotated via the gears 54. The directions of rotation of the shafts 8 in this case are mutually opposite.

Referring again to FIG. 6, the insulating cover member 12 will be described. The cover member 12 has a rectangular shape, and has two holding parts 60, 60 on its main surface 62 which extend in the elongate direction of the cover member 12 in correspondence with the rows of contacts 28 and 30. The respective holding parts 60 protrude from the main surface 62, and are formed as integral parts of the cover member 12. Numerous slots 64 that extend in the vertical direction are formed in both sides of the holding parts 60 so that said slots 64 are lined up in the elongate direction of the holding parts 60 in positions corresponding to the contact parts 36 of the contacts 28 and 30. The contact parts 36 of the contacts 28 and 30 face these slots 64, so that these contact parts 36 can contact the mating terminals.

As shown in FIG. 5, spaces 68 which are each split in the center by a separating wall 66 are formed inside the holding parts 60. Anchoring recesses 70 are formed in the upper parts of these spaces 68, i.e., in the vicinity of the flat surfaces 61 of the holding parts 60. Apertures 72 (see FIG. 6) are formed in the center of the cover member 12 (with respect to the width of the cover member 12) at both end parts of the holding parts 60. Elongate rectangular openings 74 are formed adjacent to these apertures 72 on both sides with respect to the widthwise direction of the cover member 12. Curved grooves 78 which correspond to the above-mentioned supporting grooves 22 are formed in the walls on both sides of the openings 74, i.e., walls 76 which are separated in the elongate direction of the cover member 12. The above-mentioned second cam members 44 are disposed in these openings 74. Furthermore, openings 80 which extend across the width of the cover member 12 are formed in the vicinity of both ends of the cover member 12 to the outside of the openings 74. The openings 80 are dimensioned to receive the hook-shaped members 48 therein. Connecting parts 82 are provided on both ends of the cover member 12. A curved recess 86 which accommodates the end portion of the shaft 8 that is connected to the lever 10 is formed in the end wall 84 of one of these connecting parts 82.

In order to attach the cover member 12 to the housing 2, the cover member 12 is placed in the recessed part 4 of the housing 2, and bolts 13 are passed through the apertures 72 and fastened in place by being screwed into the female threaded portions 23 of the housing 2. In this position, as shown in FIG. 5, the anchoring end parts 38 of the above-mentioned contacts 28 and 30 are positioned in the anchoring recesses 70 of the cover member 12. As a result, the contacts 28 and 30 are placed in a state in which these contacts can flex in the lateral direction, i.e., in the direction perpendicular to the engagement direction, between the base members 26 and the anchoring recesses 70. Furthermore, the reduced-diameter parts 42 and 46 of the shafts 8 are held by the above-mentioned curved grooves 78 and supporting grooves 22, so that the shafts 8 are supported inside the housing in a manner that allows the shafts 8 to rotate. Furthermore, the lever 10 protrudes to the outside from the cut-out 5 in the housing 2, so that the lever 10 can be operated from the outside of the housing 2. Before the connectors are mated together, the shafts 8 are in the positions shown in FIG. 5. Specifically, the main bodies 34 and contact parts 36 of the contacts 28 and 30 are positioned as far to the inside as possible.

Figure 7:
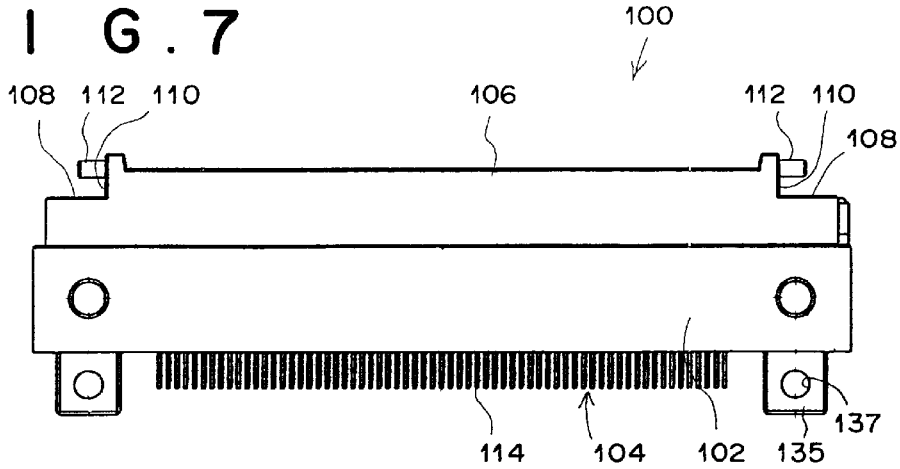
FIG. 7 is a front view of a mating connector.
Figure 8:
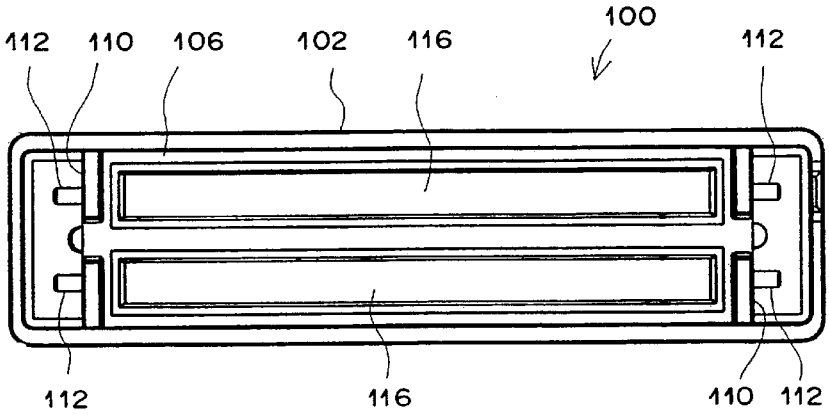
FIG. 8 is a plan view of the connector shown in FIG. 7.
Figure 9:
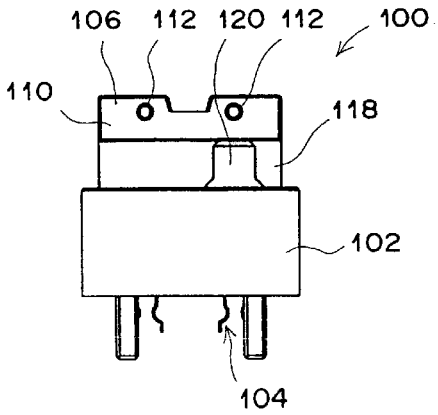
FIG. 9 is a side view of the connector shown in FIG. 7.

The mating connector 100 that engages with the connector 1 will be described with reference to FIGS. 7 through 10. FIG. 7 is a front view of the connector 100, FIG. 8 is a plan view of the connector shown in FIG. 7, FIG. 9 is a side view of the connector shown in FIG. 7, and FIG. 10 is a bottom view of the connector shown in FIG. 7.

The connector 100 has contacts 104 and an elongate rectangular housing 102. Like the housing 2, the housing 102 is also constructed from a die-cast metal in order to provide electromagnetic shielding. Step parts 108 with a shape that is complementary to that of the above-mentioned connecting parts 82 are formed in both end portions of the engaging part 106 that engages with the connector 1. Projections 112 which extend in the direction of length of the housing 102 are caused to protrude from the outward-facing end surfaces 110 of the respective step parts 108 in positions corresponding to the above-mentioned two shafts 8. The board engaging parts 114 of the contacts 104 protrude from the rear part of the connector 100, i.e., from the lower side in FIG. 7. Engaging recesses 116 that accommodate the holding parts 60 are formed side by side in the engaging parts 106 in positions corresponding to the holding parts 60 (FIG. 8). Furthermore, a key projection 120 (FIG. 9) is formed in the end surface 118 of the housing 102 in a position corresponding to the cut-out 5. This key projection 120 has a width that allows insertion of the key projection 120 into the cut-out 5 in the housing 2 of the connector 1 when the connectors are engaged with each other. As is shown in FIG. 10, the board engaging parts 114 of the connector 100 are disposed in two rows, and two pairs of these rows are installed. Each of the two boards (not shown in the figures) to which the connector 100 is attached is disposed between a pair of board engaging parts 114, and is connected to both sides of the boards. Furthermore, the boards are fastened to the connector 100 by means of screws (not shown in the figures) which are passed through the attachment holes 137 of attachment tabs 135.

Figure 11:
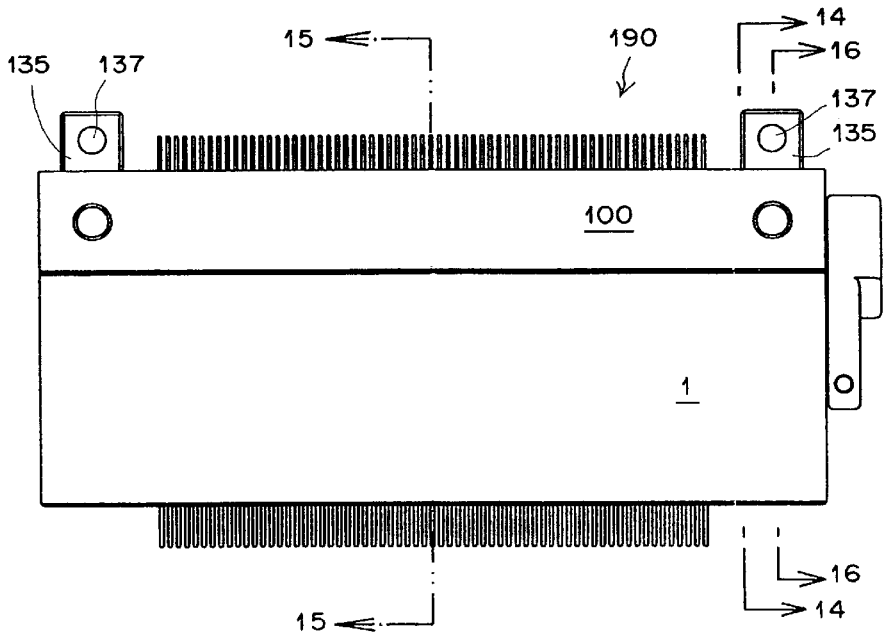
FIG. 11 is a front view which shows the connector assembly formed by the engagement of the low insertion force type connector of the present invention and the mating connector.
Figure 14:
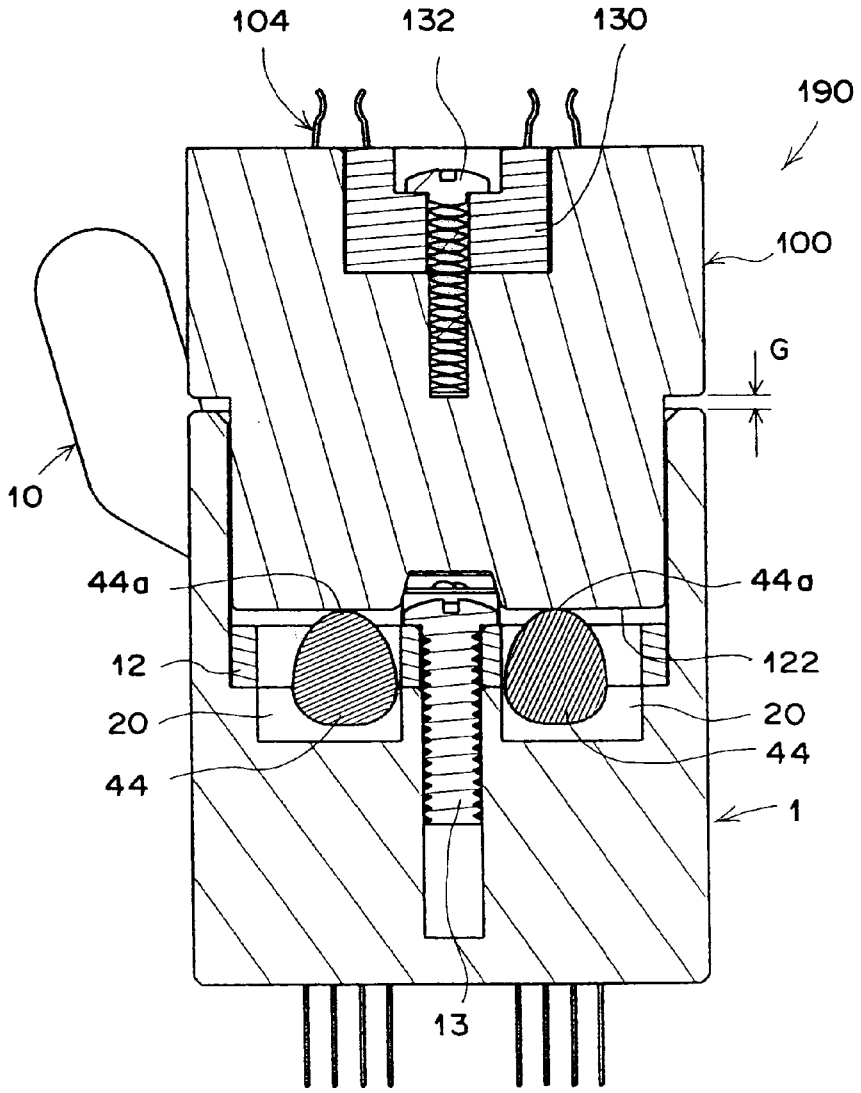
FIG. 14 is an enlarged sectional view of the connector assembly along line 14—14 in FIG. 11.
Figure 15:
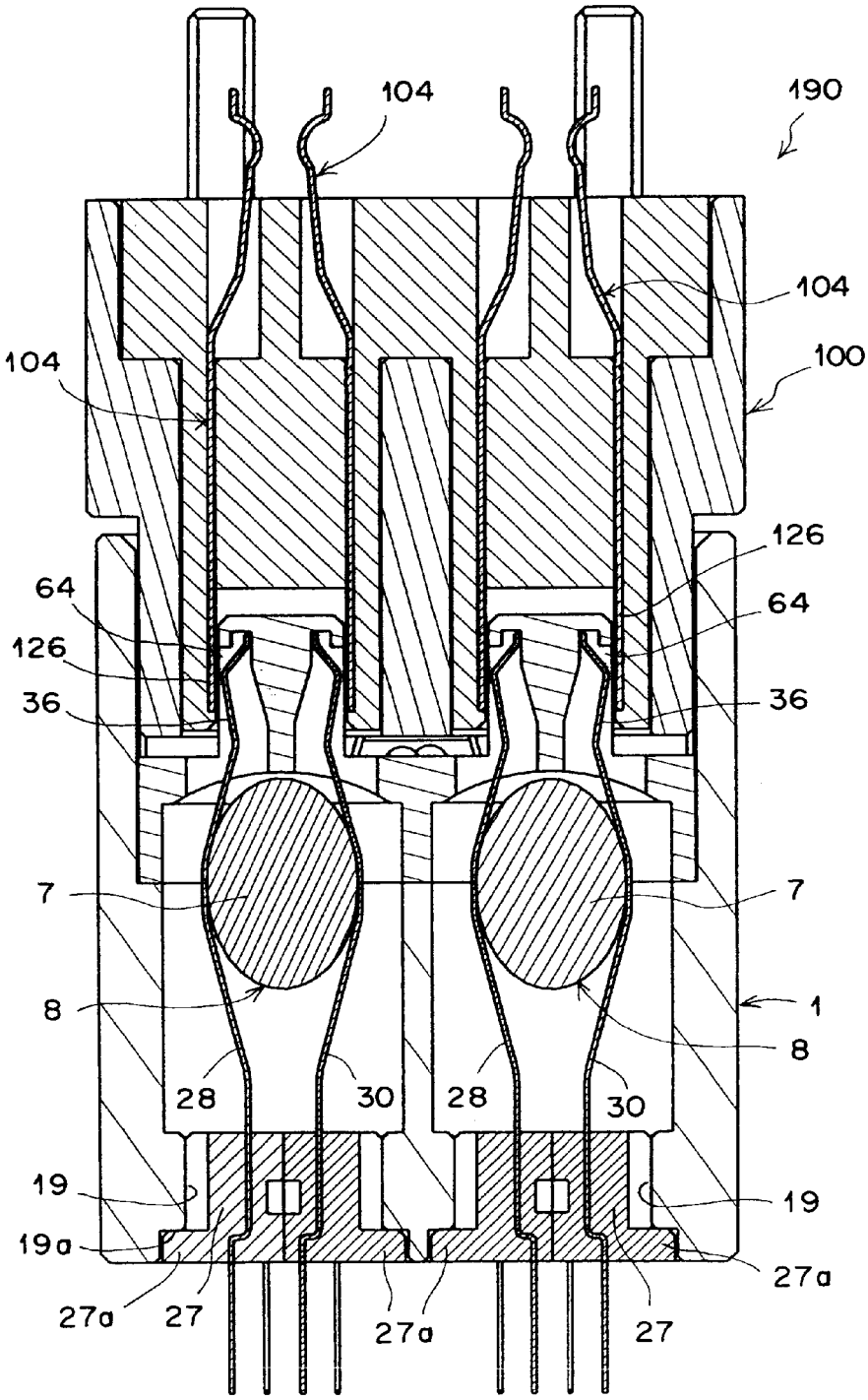
FIG. 15 is an enlarged sectional view of the connector assembly along line 15—15 in FIG. 11.

The initial engaged or mated state of the connector 1 and connector 100 will be described with reference to FIGS. 11 through 16. FIG. 11 is a front view which shows the connector assembly (hereafter referred to simply as an "assembly") 190 formed by the engagement of the connector 1 of the present invention and the mating connector 100, FIG. 12 is a side view of the assembly 190 shown in FIG. 11, FIG. 13 is a sectional view of the assembly 190 along line 13—13 in FIG. 12, FIG. 14 is an enlarged sectional view of the assembly 190 along line 14—14 in FIG. 11, FIG. 15 is an enlarged sectional view of the assembly 190 along line 15—15 in FIG. 11, and FIG. 16 is an enlarged sectional view of the assembly 190 along line 16—16 in FIG. 11.

Figure 12:
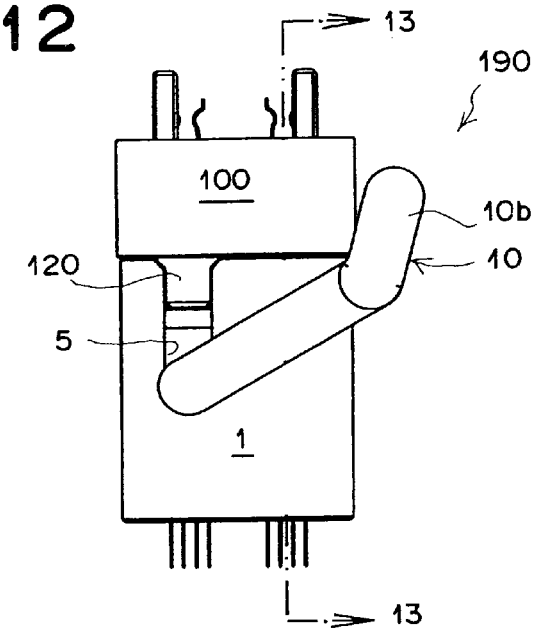
FIG. 12 is a side view of the connector assembly shown in FIG. 11.

FIGS. 11 and 12 show the initial state in which the connectors are engaged with each other; in other words, these figures show a state immediately preceding the complete engagement of the connector 100 and connector 1. Accordingly, the two connectors 1 and 100 are not completely engaged in this state. In this state, as shown most clearly in FIG. 12, the operating part 10*b* of the lever 10 is positioned on the right side of the housing 2. In FIG. 12, it is clearly shown that the key projection 120 of the connector 100 has advanced into the cut-out 5 of the connector 1. The two connectors 1 and 100 can be engaged only in the direction in which the key projection 120 and cut-out 5 engage with each other.

Figure 13:
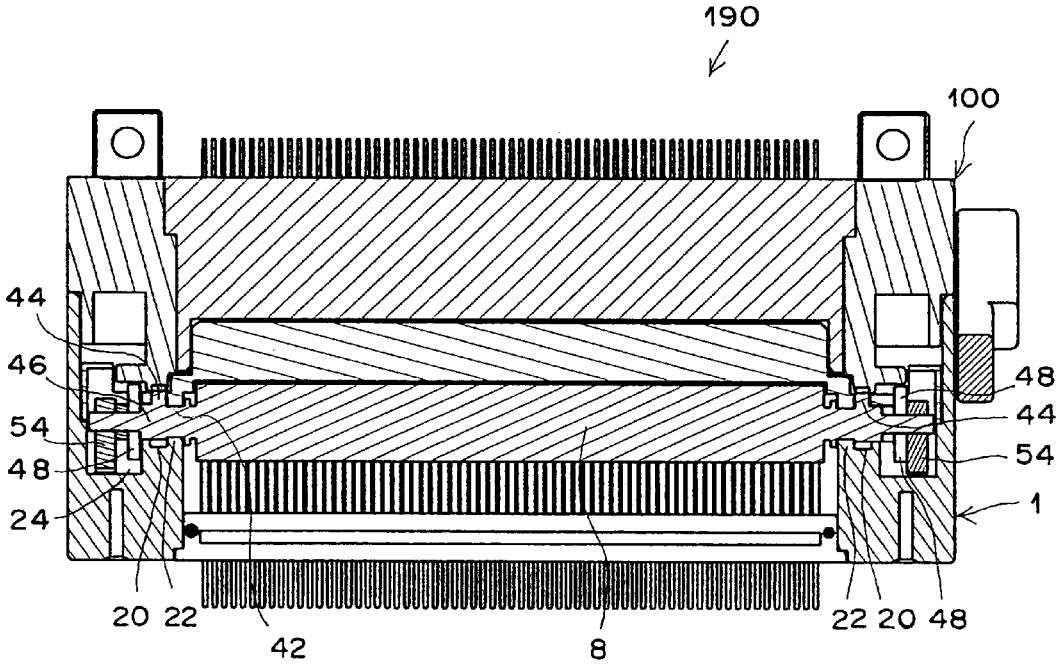
FIG. 13 is a sectional view of the connector assembly along line 13—13 in FIG. 12.

In FIG. 13, it is clearly shown that the reduced-diameter parts 42 and 46 of the shafts 8 are disposed inside the supporting grooves 22, and that the second cam members 44 are disposed in the relief grooves 20. Furthermore, it is clearly shown that the hook-shaped members 48 and gears 54 are disposed inside the spaces 24 of the housing 2.

Next, the positional relationship of the two connectors in this state, i.e., the state immediately preceding complete engagement of the connector 100 and connector 1, will be described. As shown in FIG. 14, the second cam members 44 are operable to prevent the mating connector 100 from moving beyond a partial engagement position during mating with the electrical connector 1. Specifically, when the connector 100 is inserted into the connector 1, the engaging surface 122 of the connector 100 contacts the stopping parts 44*a* of the second cam members 44 in the contact position, so that the engaging surface 122 of the connector 100 stops in a state in which a gap is left between the connector 100 and the cover member 12 of the connector 1. A gap G can be visually confirmed between the connector 1 and connector 100 from the outside of the assembly 190. Furthermore, 130 in the figures indicates a contact holding member that holds the contacts 104. This contact holding member 130 is fastened to the housing 102 by means of bolts 132.

In the state that immediately precedes complete engagement, the main bodies 7 of the shafts 8 and the contacts 28 and 30 are in the positional relationship shown in FIG. 15. Specifically, since the long diameters of the main bodies 7 are oriented in the vertical direction, the contacts 28 and 30 are in a state in which these contacts are displaced inward to the maximum extent. Accordingly, the contact parts 36 of the contacts 28 and 30 are also positioned inside the slots 64 without being urged towards the outside of the slots 64. Meanwhile, the contact parts 126 on the tip ends of the terminals of the inserted connector 100 are in a state of low contact pressure in which these contact parts 126 barely contact the contact parts 36 of the contacts 28 and 30. Accordingly, only a small insertion force is required in this case. It would also be possible to arrange the system so that absolutely no contact pressure is generated. In other words, it would also be possible for the two connectors to be engaged in a state in which the terminals 104 and contacts 28 and 30 are not in contact.

The base members 27 shown in FIG. 15 illustrate a second embodiment of the invention. Specifically, the base members 27 have ribs 27*a* that extend in the elongate direction of the base members 27 on the lower ends of both sides of the base members 27. These ribs 27*a* are inserted into the openings 19 from below and engage step parts 19*a* of openings 19 in the housing 2. In the figures referred to in the following description, the connector 1 uses the base members 27 of this second embodiment.

The positions of the hook-shaped members 48 in the state immediately preceding complete engagement will be described with reference to FIG. 16. The hook-shaped members 48 overlap each other in the areas of the claws 52, and are disposed with the tip ends 53 of the claws 52 facing upward. Accordingly, the engaging spaces 55 that are formed between the flat-plate parts 50 and claws 52 of the hook-shaped members 48 open at the top. In this case, it is important that the projections 112 of the connector 100 be located in positions that are accommodated inside the above-mentioned engaging spaces 55 when the hook-shaped members 48 are rotated. Furthermore, in regard to the square holes 50*a* located in the central portions of the flat-plate parts 50 in the figures, the shapes of the end portions of the shafts 8 are complementary shapes with respect to these square holes 50*a,* and a state is shown in which these end portions and square holes 50*a* are engaged with each other. The members with circular cross sections located to the outside of the square holes 50*a* are spacers 59 which are used to offset the two hook-shaped members 48 in the direction perpendicular to the plane of the page. Moreover, the shafts 8 may also be formed with the same cross-sectional shape from the gear 54 on one end to the gear 54 on the other end. Furthermore, the cross-sectional shape of the shafts 8 may be a shape other than square, such as triangular or hexagonal.

Figure 17:
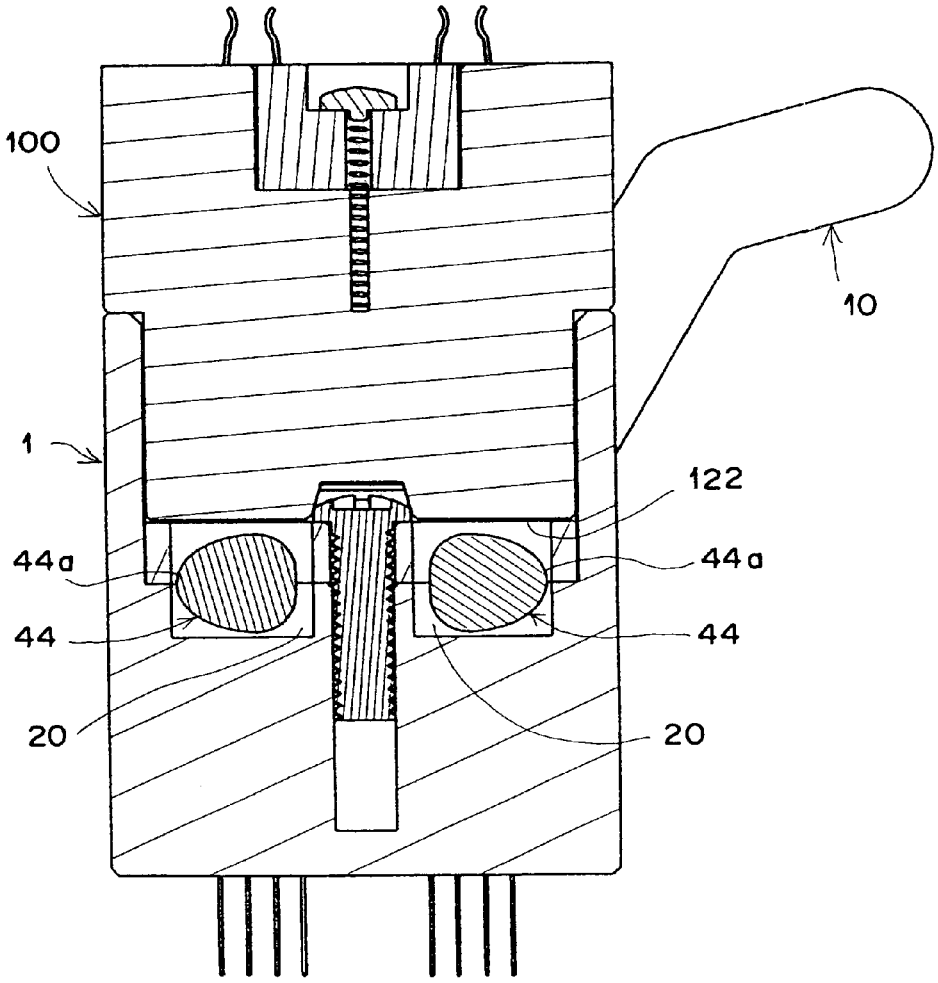
FIG. 17 is an enlarged sectional view (similar to FIG. 14) along line 14—14 in FIG. 11, showing the connector assembly in a completely engaged state.
Figure 18:
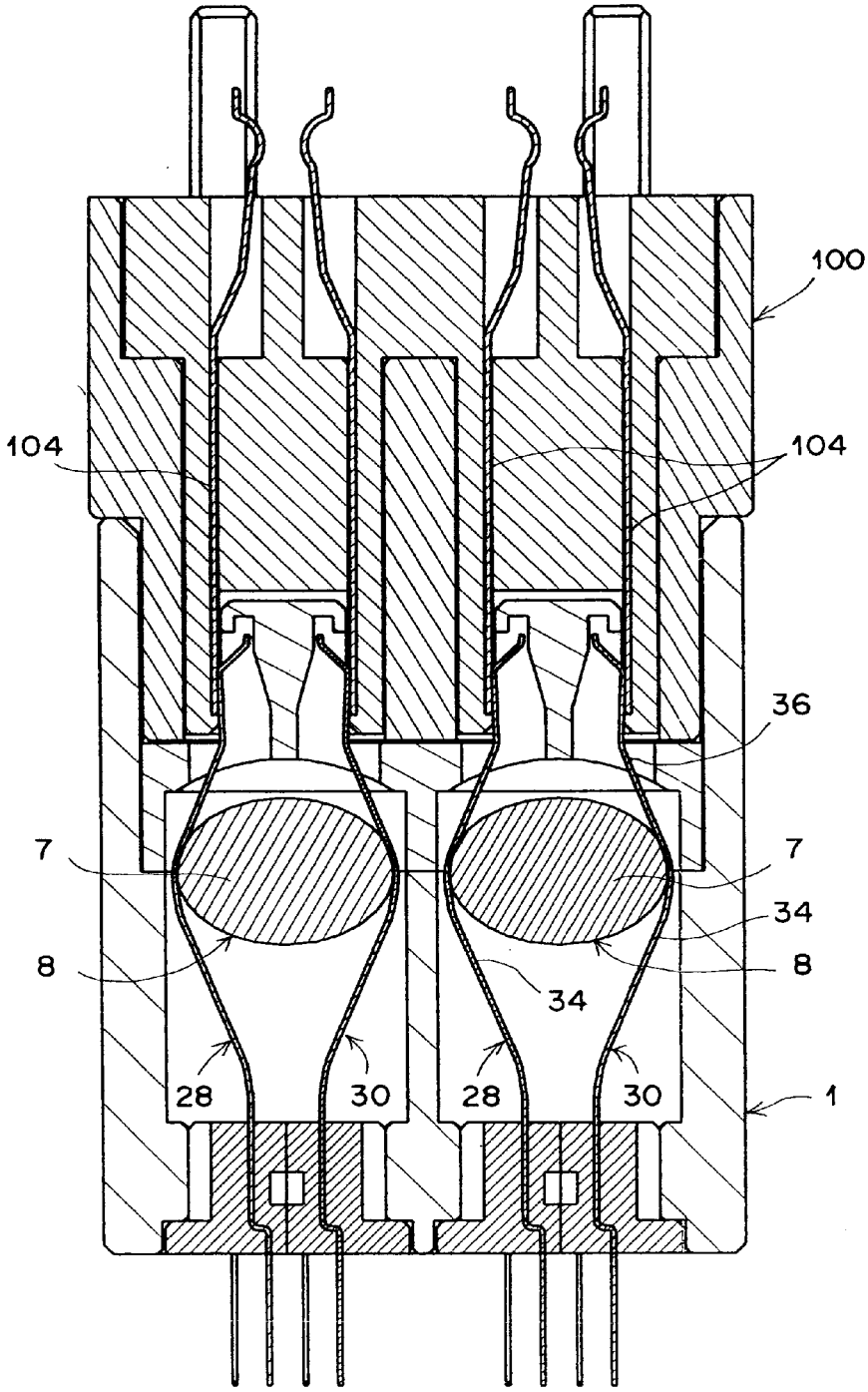
FIG. 18 is an enlarged sectional view (similar to FIG. 15) along line 15—15 in FIG. 11, showing the connector assembly in a completely engaged state.
Figure 19:
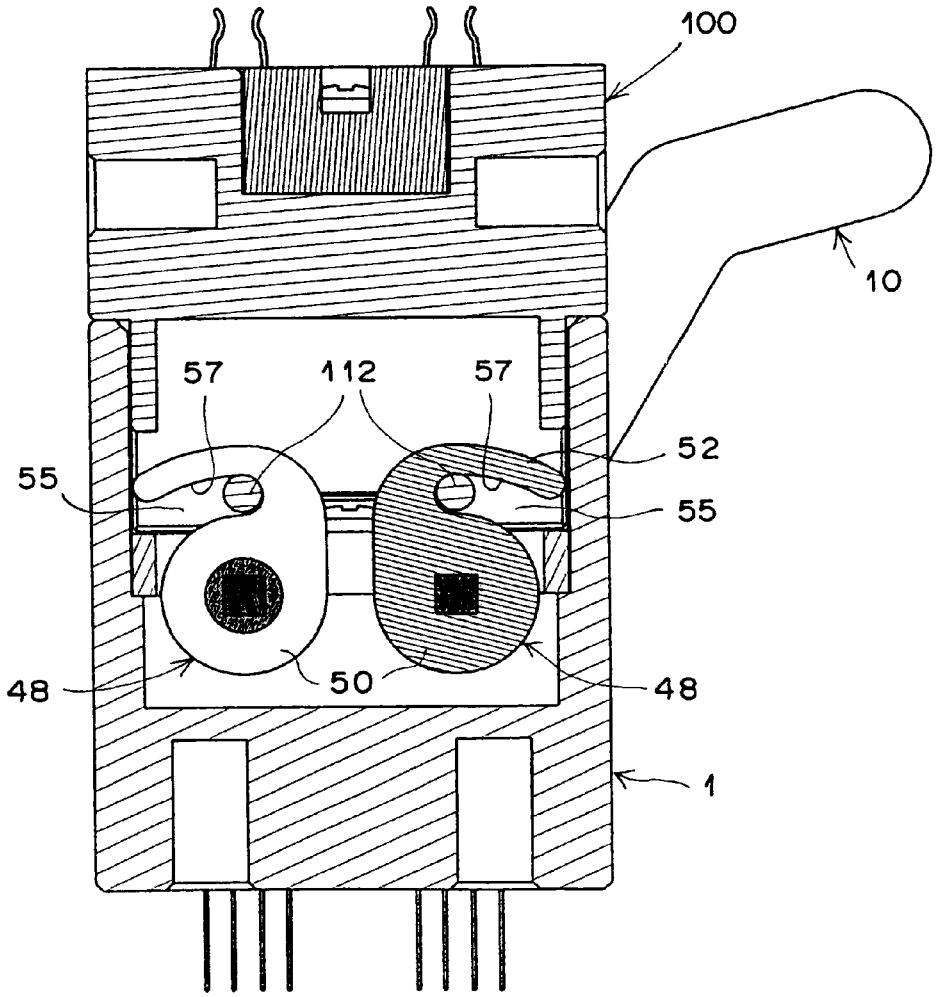
FIG. 19 is an enlarged sectional view (similar to FIG. 16) along line 16—16 in FIG. 11, showing the connector assembly in a completely engaged state.

Next, the state that results when the lever 10 is turned so that the connectors are completely engaged with each other will be described. FIG. 17 is an enlarged sectional view (similar to FIG. 14) along line 14—14 in FIG. 11 showing the assembly 190 in a state in which the shafts 8 have been rotated approximately 90°, i.e., in a completely engaged state. FIG. 18 is an enlarged sectional view (similar to FIG. 15) of the assembly 190 in a case where the shafts 8 have similarly been rotated approximately 90°. FIG. 19 is a sectional view of the assembly 190 along line 16—16 (similar to FIG. 16) showing a state in which the shafts 8 have similarly been rotated approximately 90° C., so that the hook-shaped members 48 and projections 112 are engaged. The following description will refer to FIGS. 17 through 19.

When the lever 10 is turned approximately 90°, the second cam members 44 also move in linkage with the shafts 8, so that the second cam members 44 rotate in mutually opposite directions. In this case, the slopping parts 44*a* of the second cam members 44 which have been in contact with the engaging surface 122 of the connector 100 are separated from the engaging surface 122, and assume a lateral orientation inside the relief grooves 20. Specifically, the second cam members 44 axe placed in non-contact positions in order to release the mating connector 100 for movement beyond the partial engagement position. Accordingly, the connector 100 can advance further with respect to the connector 1. As a result of being turned, the lever 10 is placed in a position that is on the opposite side from the position shown in FIG. 14, and the connector 100 shown in FIG. 17 is in a position of complete engagement or mating.

Next, the relationship of the contacts 28 and 30 and terminals 104 will be described with reference to FIG. 18. When the main bodies 7 or first cam members of the shafts 8 rotate approximately 90°, the long diameters of the main bodies 7 are oriented in the lateral direction, and push the main bodies 34 of the contacts 28 and 30 to the outside. As a result, the contact parts 36 of the contacts 28 and 30 are also displaced to the outside, and are urged toward the terminals 104 of the connector 100, so that these contact parts 36 contact the terminals 104. As a result, electrical connections are established between the terminals 104 and the contacts 28 and 30.

The locking of the connectors to each other will be described with reference to FIG. 19. When the projections 112 of the connector 100 begin to advance into the engaging spaces 55 of the hook-shaped members 48 as the shafts 8 rotate, the insides of the claws 52, i.e., the engaging cam surfaces 57 that form the side edges on the outsides of the engaging spaces 55, engage with the projections 112. The engaging cam surfaces 57 are formed so that these cam surfaces 57 approach the centers of the flat-plate parts 50, i.e., the axial centers of the shafts 8, as the cam surfaces 57 move further into the engaging spaces 55. In other words, the engaging cam surfaces 57 are formed with a gradual increase in curvature. Accordingly, the projections 112 are pulled into the connector 1 as the hook-shaped members 48 are rotated. Specifically, the connector 100 is pulled into the connector 1, and wiping is performed between the terminals 104 and the contacts 28 and 30; furthermore, as a result, the connectors are locked in a completely engaged or mated position. The lever 10 can be smoothly turned; when locking occurs, the complete engagement of the connectors with each other can be confirmed as a result of this locking. Furthermore, since the gap G between the connectors shown in FIG. 14 is eliminated, it can be confirmed from the external appearance that the connectors are completely engaged with each other; moreover, the housings 2 and 102 are electrically connected to each other.

The present invention was described in detail above; however, the contact urging means may have some other construction. Specifically, it would also be possible to dispose the contact urging means to the outside of the contact rows, and to form the contacts beforehand with a shape that bows outward. The contacts may be arranged so that the contacts are caused to flex inward only when the contacts are urged inward from the outside by the contact urging means. In this case, when the connectors are engaged, the contact urging means operates so that the contacts are caused to flex inward; following the completion of engagement, the contact urging means is released, so that the contacts return outward, thus causing an electrical connection to be established between the connectors.

Furthermore, in cases where electromagnetic shielding is not an object, the housing 2 may also be made of a synthetic resin.

What is claimed is:

1. An electrical connector comprising:

a housing that holds a plurality of contacts that mate with terminals of a mating connector;

a first cam member arranged in the housing and operable to deflect the contacts into engagement with the terminals;

a second cam member arranged in the housing and operable in one position to prevent the mating connector from moving beyond a partial engagement position during mating with the electrical connector, the second cam member being movable to another position to release the mating connector for movement beyond the partial engagement position;

a lock member arranged in the housing and operable for moving the mating connector from the partial engagement position to a full engagement position; and a driving mechanism that is arranged to drive the first cam member, the second cam member and the lock member such that the first cam member deflects the contacts into engagement with the terminals and the second cam member releases the mating connector for movement beyond the partial engagement position as the lock member moves the mating connector from the partial engagement position to the full engagement position.

2. The electrical connector of claim 1 wherein the lock member includes a hook-shaped member with a camming surface that engages with a projection on the mating connector to draw the mating connector to the full engagement position.

3. The electrical connector of claim 1 wherein the driving mechanism includes a shaft that is rotatably supported in the housing, and the first cam member, the second cam member and the lock member are integrally formed on the shaft.

4. The electrical connector of claim 2 wherein a lever is attached to the shaft.

5. The electrical connector of claim 1 wherein the driving mechanism includes a pair of said shafts that are rotatably linked by gears.

* * * * *